US008774449B2

(12) United States Patent
Kajihara et al.

(10) Patent No.: US 8,774,449 B2
(45) **Date of Patent: *Jul. 8, 2014**

(54) SPEAKER DIAPHRAGM, SPEAKER DUST CAP, SPEAKER FRAME, SPEAKER USING SAID PARTS, AND ELECTRONIC EQUIPMENT AND DEVICE USING SAID SPEAKER

(75) Inventors: Yoshimichi Kajihara, Mie (JP); Yohei Jin, Mie (JP); Toru Fujii, Shiga (JP)

(73) Assignee: Panasonic Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/514,658

(22) PCT Filed: Dec. 24, 2010

(86) PCT No.: PCT/JP2010/007468

§ 371 (c)(1),
(2), (4) Date: Jun. 8, 2012

(87) PCT Pub. No.: WO2011/080898

PCT Pub. Date: Jul. 7, 2011

(65) Prior Publication Data

US 2012/0257781 A1 Oct. 11, 2012

(30) Foreign Application Priority Data

Dec. 28, 2009 (JP) ..... 2009-297405
Jan. 20, 2010 (JP) ..... 2010-009773
Jan. 20, 2010 (JP) ..... 2010-009774

(51) Int. Cl.
*H04R 1/00* (2006.01)
*H04R 31/00* (2006.01)
*H04R 7/12* (2006.01)

(52) U.S. Cl.
CPC ..... *H04R 31/003* (2013.01); *H04R 2400/11* (2013.01); *H04R 2499/15* (2013.01); *H04R 2307/021* (2013.01); *H04R 2231/001* (2013.01); *H04R 2307/029* (2013.01); *H04R 2499/13* (2013.01); *H04R 2307/023* (2013.01); *H04R 2307/025* (2013.01); *H04R 7/122* (2013.01)
USPC ..... 381/426; 381/423; 381/428; 181/167; 181/169

(58) Field of Classification Search
USPC ..... 381/426–428; 181/167–170
See application file for complete search history.

(56) References Cited

U.S. PATENT DOCUMENTS 4,412,103 A * 10/1983 Fujii et al. ..... 181/167
5,581,053 A * 12/1996 Suzuki et al. ..... 181/167

(Continued)

FOREIGN PATENT DOCUMENTS

CN 101043763 A 9/2007
JP 59176995 A 10/1984

(Continued)

OTHER PUBLICATIONS

International Application Serial No. PCT/JP2010/007468, International Search Report mailed Apr. 19, 2011, 8 pgs.

(Continued)

*Primary Examiner* — Curtis Kuntz
*Assistant Examiner* — Ryan Robinson
(74) *Attorney, Agent, or Firm* — RatnerPrestia

(57) ABSTRACT

Each of a speaker diaphragm, a dust cap, and a frame includes a resin and a plant opal that is extracted from a bamboo leaf, and is formed by injection molding or sheet molding. The configuration can enhance stiffness of each of the diaphragm, the dust cap, and the frame and implement high performance.

20 Claims, 5 Drawing Sheets

(56) References Cited

U.S. PATENT DOCUMENTS

| | | | | |
|---|---|---|---|---|
| 6,554,962 | B2 * | 4/2003 | Uryu et al. | 162/218 |
| 6,638,354 | B2 * | 10/2003 | Stephens et al. | 106/624 |
| 8,340,342 | B2 | 12/2012 | Jin et al. | |
| 2007/0131478 | A1 | 6/2007 | Okazaki et al. | |
| 2007/0223770 | A1 | 9/2007 | Fujisawa et al. | |
| 2009/0080687 | A1 * | 3/2009 | Mimura et al. | 381/428 |
| 2010/0059309 | A1 | 3/2010 | Kajihara et al. | |
| 2010/0172533 | A1 | 7/2010 | Kajihara et al. | |
| 2011/0164764 | A1 | 7/2011 | Jin et al. | |

FOREIGN PATENT DOCUMENTS

| | | | | |
|---|---|---|---|---|
| JP | 61-114696 | A | 6/1986 | |
| JP | 01-174100 | A | 7/1989 | |
| JP | 01174100 | A | 7/1989 | |
| JP | 2004274661 | A | 9/2004 | |
| JP | 2005236497 | A | 9/2005 | |
| JP | 2006222485 | A | 8/2006 | |
| JP | 2009089302 | A | 4/2009 | |
| JP | 2009089303 | A | 4/2009 | |
| WO | WO 2008/084641 | A1 | 7/2008 | |
| WO | WO 2009/090857 | * | 7/2009 | H04R 7/12 |
| WO | WO 2009/090857 | A1 | 7/2009 | |

OTHER PUBLICATIONS

Chinese Search Report for Application No. 201080059589.2, dated Feb. 21, 2014.

* cited by examiner

SPEAKER DIAPHRAGM, SPEAKER DUST CAP, SPEAKER FRAME, SPEAKER USING SAID PARTS, AND ELECTRONIC EQUIPMENT AND DEVICE USING SAID SPEAKER

This Application is a U.S. National Phase Application of PCT International Application No. PCT/JP2010/007468 filed on Dec. 24, 2010.

TECHNICAL FIELD

The present invention relates to a speaker diaphragm, a speaker dust cap, a speaker frame, a speaker using the same, which are used in various acoustic devices and video devices, an electronic device such as a stereo set and a television set, and an apparatus.

BACKGROUND ART

Recently, with spread of a digital technology in electronic devices such as an acoustic device and a video device, there is a strong demand to improve performance of a speaker used in the electronic devices. Particularly, in components constituting the speaker, performance of a diaphragm largely affect a determination of sound quality, and there is a need for development of a high-performance diaphragm implementing the better sound quality. A method of producing conventional speaker diaphragm will be described with reference to the drawing. FIG. 10 is a sectional view illustrating a conventional resin speaker diaphragm, which is formed by injection molding. Diaphragm 7 is produced such that a pellet of a resin such as polypropylene is thermally dissolved and injected in a mold in which a shape setting is previously performed. Generally a single material such as polypropylene is used as a kind of the resin material used in the injection molding. Additionally, in order to adjust a physical property of the diaphragm, namely, a characteristic and sound quality of the speaker, sometimes different kinds of resins are mixed and used as the material for diaphragm 7.

As to the physical property that is hardly adjusted only by the resin, the physical property is adjusted by mixing a reinforcing material such as mica, thereby adjusting the characteristic and sound quality of the speaker. A pulp material is mixed in order to increase a degree of freedom of the physical property adjustment, thereby adjusting the sound quality. In the diaphragm in which the resin and the pulp material are mixed, the degree of freedom of the sound quality adjustment is increased, and moisture-resistant reliability can be ensured. However, there is the demand to improve the sound quality.

For example, PTL 1 and PTL 2 are known as a technology related to the subject application.

CITATION LIST

Patent Literature

PTL 1: Unexamined Japanese Patent Publication No. S59-176995

PTL 2: Unexamined Japanese Patent Publication No. 2005-236497

SUMMARY OF THE INVENTION

The present invention configures at least one of a speaker diaphragm, a speaker dust cap, and a speaker frame, which are formed by injection molding or sheet molding while including a resin and a plant opal extracted from a bamboo leaf. In the speaker diaphragm having the above configuration, stiffness and sound velocity of the diaphragm are improved by mixing the plant opal contained in the bamboo leaf in the resin. Therefore, a playback frequency bandwidth of the speaker can be expanded, a strain of the speaker can be reduced, and the good sound quality can be implemented.

Additionally, the stiffness and sound velocity of the speaker dust cap can be improved by mixing the plant opal contained in the bamboo leaf in the resin.

Compared with the conventional speaker frame, a weight and a specific weight of the speaker frame can be reduced by mixing the plant opal contained in the bamboo leaf in the resin, and the stiffness can be enhanced.

The present invention is a speaker in which at least one of the speaker diaphragm, the speaker dust cap, and the speaker frame is used, and an electronic device and an apparatus in which the speaker is used.

DESCRIPTION OF EMBODIMENTS

Hereinafter, exemplary embodiments of the present invention will be described. However, the present invention is not limited to the exemplary embodiments.

First Exemplary Embodiment

A speaker diaphragm (hereinafter referred to as a diaphragm) according to a first exemplary embodiment of the present invention will be described below.

Figure 1:
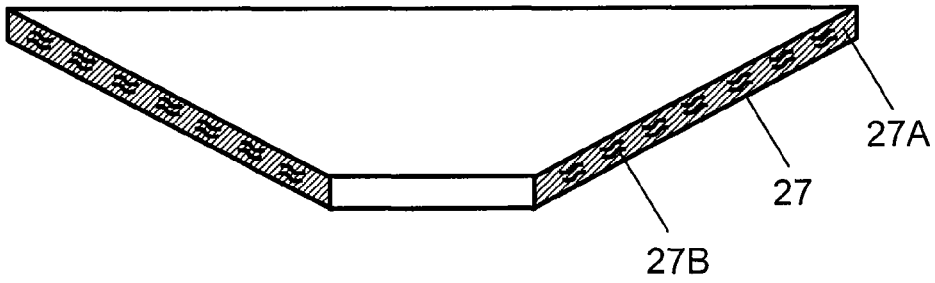
FIG. 1 is a sectional view illustrating a speaker diaphragm according to a first exemplary embodiment of the present invention.
Figure 2:
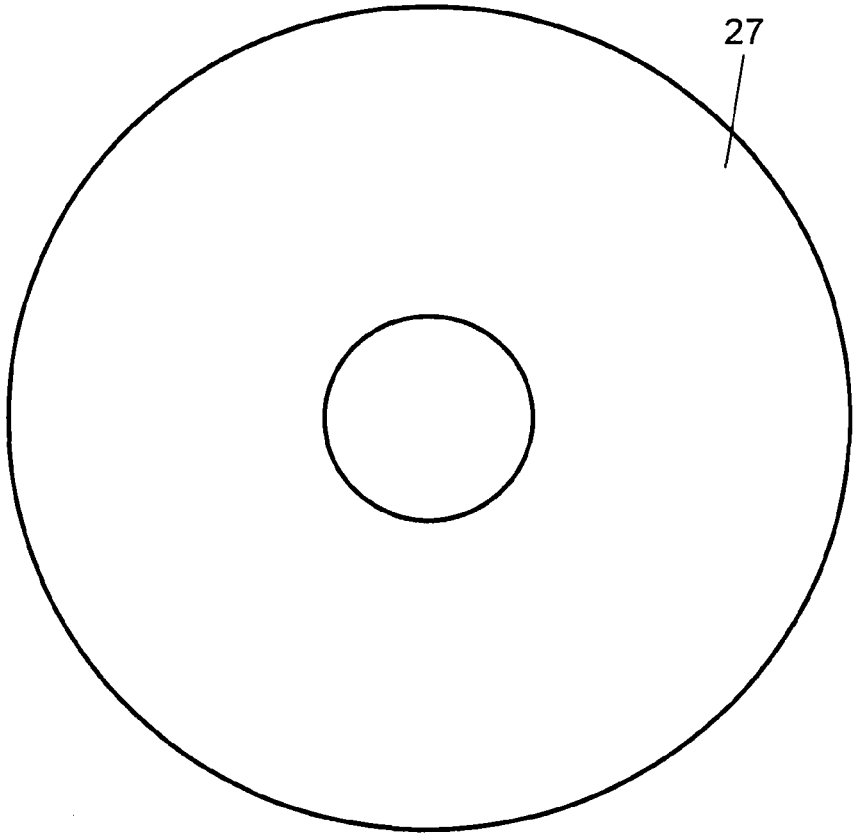
FIG. 2 is a plan view illustrating the speaker diaphragm of the first exemplary embodiment of the present invention.

FIG. 1 is a sectional view illustrating the diaphragm of the first exemplary embodiment. FIG. 2 is a plan view illustrating the diaphragm of the first exemplary embodiment. Diaphragm 27 includes resin 27A and plant opal 27B that is extracted from a bamboo leaf. As illustrated in FIGS. 1 and 2, diaphragm 27 is formed by injection molding or sheet molding of the materials. Diaphragm 27 may include a material except the above materials.

The plant opal extracted from the bamboo leaf is used as the material for diaphragm 27, thereby enhancing a bending elastic modulus of diaphragm 27. Stiffness and sound velocity of diaphragm 27 are enhanced to reduce a strain, which allows expansion of a playback frequency bandwidth.

There is no particular limitation to a method for extracting the plant opal (silicon dioxide compound) from the bamboo leaf. Specifically a method, in which the bamboo leaf is dried to remove moisture, the bamboo leaf is powderized with a mixer, and the bamboo leaf is classified with a sieve, is desirable for yield. There is another method, in which the bamboo leaf is crushed by applying a pressure, dispersed in water, and distinguished settled powders from floating powders in an aqueous solution using difference in specific gravity. The plant opal may be extracted from the bamboo leaf by any method.

Desirably the mix rate of the plant opal extracted from the bamboo leaf ranges from 5 wt % to 50 wt % inclusive. When the mix rate of the plant opal contained in the bamboo leaf is lower than 5 wt %, there is little action of the enhancement of the bending elastic modulus. On the other hand, when the mix rate of the plant opal extracted from the bamboo leaf exceeds 50 wt %, it is difficult that the plant opals are evenly dispersed in the resin, and it is difficult due to decreased fluidity that the thin diaphragm is molded by the injection molding.

The same effect can be obtained even if a plant opal extracted from a bamboo-grass leaf that are of the same poaceous plant is used instead of the plant opal extracted from the bamboo leaf.

Desirably a particle diameter of plant opal 101B used ranges from 5 μm to 20 μm.

Desirably a plant-based fiber is mixed as the material for diaphragm 27. The mix of the plant-based fiber can play back a natural, bright tone color, and suppress a dark, uniformed tone color unique to the resin. The mixed plant-based fiber may be either a wood pulp or a non-wood pulp. Desirably the bamboo fiber that is of the non-wood is mixed. A degree of freedom of adjustment of a physical property such as the sound velocity is increased because the bamboo fiber has a higher elastic modulus compared with other pulp materials. From the viewpoint of extracting the plant opal from the bamboo leaf, the use of the bamboo fiber as the plant-based fiber saves a resource. The bamboo fiber is good for an environment because a growth speed of the bamboo is faster than that of the wood.

There is no particular limitation to the bamboo fiber as long as the bamboo fiber is derived from a bamboo-family plant. Any bamboo that is, excluding a bamboo shoot and a young bamboo less than one year, grown for at least one year may be used as the bamboo fiber.

As to the age of the bamboo, the stiffness and toughness necessary for the present invention can minimally be ensured by the bamboo that is grown for at least one year, and the stiffness and toughness are further enhanced when the bamboo is grown for at least two years.

The bamboo fiber may be used at all ages except the decayed state.

Desirably the mix rate of the bamboo fiber ranges from 5 wt % to 60 wt % inclusive. When the mix rate of the bamboo fiber ranges from 5 wt % to 60 wt % inclusive, an effect of kneading of resin 27A and plant opal 27B extracted from the bamboo leaf is exerted good, and productivity and quality are improved. Particularly, when the mix rate of the bamboo fiber exceeds 51 wt %, the diaphragm can be incinerated and disposed as not the resin but the bamboo fiber. When the mix rate of the bamboo fiber is lower than 5 wt %, there is a little effect that is obtained by adding the bamboo fiber. On the other hand, when the mix rate of the bamboo fiber is more than 60 wt %, it takes a long time to perform the kneading of resin 27A and plant opal 27B extracted from the bamboo leaf. Additionally, because the injection molding is hardly performed, the productivity and dimensional stability are degraded, and the degree of freedom of the shape is decreased.

In addition to the bamboo fiber (normal bamboo fiber), a bamboo fiber that is fined into a microfibril state having a beating degree of 25 cc or less may be added as the plant-based fiber that is added as the material for diaphragm 27.

As used herein, the bamboo fiber that fined into the microfibril state means one in which the bamboo fiber is beaten into the microfibril state. In a beating process, an average fiber diameter is decreased while an average fiber length is substantially kept constant. An entanglement between fibers, particularly an entanglement with another material can be strengthened, and therefore the stiffness and toughness of diaphragm 27 can be enhanced.

In the case of the addition of the bamboo fiber that is fined into the microfibril state having the beating degree of 25 cc or less, desirably the total mix rate of the normal bamboo fiber and the bamboo fiber that is fined into the microfibril state having the beating degree of 25 cc or less ranges from 5 wt % to 60 wt % inclusive.

The bamboo fiber that is fined into the microfibril state has an elastic modulus higher than that of the normal bamboo fiber. The bamboo fiber that is fined into the microfibril state exists partially to strengthen bonding between the fibers. The effects synergistically enhance the elastic modulus compared with the case that only the normal bamboo fiber is mixed. Therefore, the sound velocity is enhanced.

Bamboo powders may be added as the plant-based fiber in addition to the bamboo fiber, or the bamboo powders may be added instead of the bamboo fiber. The use of the bamboo powder can make the more natural, bright tone color. Desirably the particle diameter of the bamboo powder used ranges from 1 μm to 150 μm.

A bamboo charcoal may be added as the plant-based fiber in addition to the bamboo fiber, or the bamboo charcoal may be added instead of the bamboo fiber. The bamboo fiber is charred, and the bamboo fiber is used in a bamboo charcoal state, so that the elastic modulus and the internal loss can be enhanced to improve performance of the diaphragm. Desirably the particle diameter of the bamboo charcoal ranges from 1 μm to 150 μm.

When the bamboo charcoal that is of the charred bamboo material is mixed in the resin, desirably the particle diameter of the bamboo charcoal is equal to or lower than 150 μm. When the particle diameter of the bamboo charcoal is more than 150 μm, the bamboo charcoal is hardly dispersed in the resin, which causes an appearance defect and a quality variation. A lower limit of the particle diameter does not particularly exist. In consideration of a fiber characteristic, desirably the particle diameter of the bamboo charcoal is equal to or more than 1 μm.

When the particle diameter of the bamboo charcoal is brought close to the particle diameter of plant opal 101B extracted from the bamboo leaf, dispersibility is improved, and the diaphragm functions more effectively.

A process of charring the bamboo material means a process of burning the bamboo material at a temperature of 600° C. or more irrespective of a form of the bamboo material.

A coloring agent such as a pigment may be mixed. However, the use of the bamboo fiber in the charred state eliminates the mix of the black coloring agent.

A reinforcing material may be mixed, when diaphragm 27 is strengthened, when a sound is slightly accented, or when the sound quality is adjusted while a sound pressure frequency characteristic has a peak. Examples of the reinforcing material include mica, graphite, talc, a calcium carbonate, clay, and a carbon fiber, and an aramid fiber. For example, when mica is mixed as the reinforcing material, the elastic modulus can be enhanced. When graphite is mixed as the reinforcing material, the elastic modulus and an internal loss can be increased. When at least one of talc, the calcium carbonate, and clay is mixed as the reinforcing material, the internal loss can be increased. When the aramid fiber is used as the reinforcing material, the bamboo fiber and the aramid fiber are tangled with each other, and the internal loss can be enhanced without decreasing the elastic modulus. When the aramid fiber that is fined into the microfibril state is used, the entanglement between the fibers is strengthened, so that the high elastic modulus and the high internal loss can be achieved. In addition to the aramid fiber, a high-strength, high-elastic-modulus fiber such as the carbon fiber may be used as a chemical fiber.

Use of a compatibilizing agent improves compatibility of a nonpolar resin such as polypropylene and the plant opal extracted from the bamboo leaf, and therefore the elastic modulus and a heat resistance property can be improved. Particularly, a silane having a vinyl group, a methacryloxy group, or a mercapto group is desirably used as the compatibilizing agent. Specifically, examples of the compatibilizing agent include vinyl trimethoxy silan, vinyl triethoxy silan, 3-methacryloxy propyl methyldimethoxy silane, 3-methacryloxy propyl trimethoxy silane, 3-methacryloxy propyl methyldiethoxy silane, 3-methacryloxy propyl triethoxy silane, 3-mercapto propyl methyldimethoxy silane, and 3-mercapto propyl trimethoxy silane. The compatibilizing agent is not limited to the above materials, but any silane coupling agent may be used. The nonpolar resin may be denatured using maleic anhydride to provide a polarity.

Desirably polypropylene is used as resin 27A. Polypropylene is crystalline, and has a relatively high heat resistance property and good moldability. Because polypropylene has a small specific weight, polypropylene effectively reduces a weight of the diaphragm. When polymethylpentene is used as an olefin resin except polypropylene, the weight reduction is effectively achieved. When both a crystalline resin and an amorphous resin are used according to the intended use, the resin material satisfies the optimum physical property. Additionally, engineering plastics and environment-friendly plant-based resins typified by polylactic acid may be used. As used herein, the engineering plastic means a high-function plastic having the bending elastic modulus of 1900 MPa and a long-term heat resistance property of 100° C. Modified polyphenylene (PPE), polyacetal (POM), polybuthylene terephthalate (PBT), polyethylene terephthalate (PET), and polycarbonate (PC) can be cited as an example of the engineering plastic.

Particularly, polylactic acid is a biodegradable plastic, the diaphragm made of polylactic acid becomes an environment-conscious diaphragm, and an earth-conscious speaker diaphragm can be constructed. Polylactic acid has relatively better compatibility with the bamboo material compared with polypropylene, and the compatibility of polylactic acid further improved when tannin and the like are used as the compatibilizing agent.

A combination of the above materials can freely adjust the physical properties of diaphragm 27 at high accuracy, and the predetermined characteristic and sound quality can be implemented. Accumulated know-how related to characteristic making and sound making is necessary to implement the predetermined characteristic and sound quality. Generally, the predetermined characteristic and sound quality are performed by the following method. That is, the characteristic making and sound making of the speaker can be changed to some extent by changing a parameter of a component, thereby bringing the speaker close to the predetermined characteristic and sound quality.

For example, it is assumed that, except diaphragm 27, the parameters of all the components of the speaker are kept constant. In addition to the physical property, examples of variable parameters of diaphragm 27 include an area, a shape, a weight, and a thickness. However, the area, the shape, the weight, and the thickness of diaphragm 27 are substantially fixed at an initial stage of speaker design. That is, the sound pressure frequency characteristic and sound quality of the speaker are substantially fixed by the conditions except the physical property of diaphragm 27. In this case, unnecessary peak and dip are generated on the sound pressure frequency characteristic, and frequently the strain is largely generated in a specific frequency band.

As to the sound quality, the tone color largely depends on the sound pressure frequency characteristic. These are caused by the area, the shape, the weight, and the thickness of diaphragm 27, particularly caused by a vibration mode of diaphragm 27. In order to improve the unnecessary peak, dip, strain to obtain the good sound quality, a procedure to select the diaphragm material can be performed as follows.

A material that satisfies the sound pressure frequency characteristic, the sound quality, and a reliability grade, which are required for the speaker, is selected as resin 27A, plant opal 27B extracted from the bamboo leaf, and another mixed material. In this case, resin 27A that becomes a base is selected in consideration of the reliability such as a heat-resistant grade, and a material in which the unique tone color of resin 27A is close to the predetermined tone color is selected. The material is selected in consideration of the unnecessary peak or dip to be eliminated on the sound pressure frequency characteristic.

For the countermeasure against the dip, a resin material having the same resonant frequency as the dip is selected. For the countermeasure against the peak, a resin material having the same internal loss frequency as the peak is selected. The materials for resin 27A and plant opal 27B extracted from the bamboo leaf and another mixed material are selected in consideration of the density, elastic modulus, internal los, and tone color of the material and the resonant frequency in forming the material into the shape of diaphragm 27. The selected materials are subjected to the kneading to prepare a master batch pellet for the injection molding. In the master batch pellet, plant opal 27B extracted from the bamboo leaf is densely filled. Using the master batch pellet, diaphragm 27 is produced by the injection molding.

The physical properties of diaphragm 27 are measured and evaluated. Trial production of the speaker is performed using diaphragm 27, the characteristic and sound quality are actually measured, and final evaluation is performed by trial listening. In the case that the predetermined characteristic and sound quality are not obtained by the evaluation, the trial production process is repeatedly performed. Through the trial production process, the material selection and a blend ratio are improved to bring the characteristic and the sound quality close to the target characteristic and sound quality.

Diaphragm 27 that satisfies or is close to the predetermined characteristic and sound quality can be finished by repeating the above process.

Generally polypropylene is easily available and injection molding of polypropylene is easily performed. However, in the first exemplary embodiment, the resin material is not limited to polypropylene, but various material can be used according to the desired characteristic value.

As described above, diaphragm 27 is formed by the injection molding or the sheet molding while including the resin and the plant opal extracted from the bamboo leaf. In the above configuration, the plant opal contained in the bamboo leaf is mixed in the resin, whereby the stiffness of diaphragm 27 can be enhanced while moisture-resistant, water-resistant reliability that is of one of the features of the resin diaphragm is retained. The degree of freedom of physical property setting of diaphragm 27 can be increased to obtain the diaphragm having the excellent appearance. Diaphragm 27 is obtained by the injection molding or the sheet molding, thereby improving the productivity and the dimensional stability. The stiffness and sound velocity of diaphragm 27 are improved, the playback frequency bandwidth of the speaker is expanded, and the strain of the speaker is reduced, so that the good sound quality can be implemented. The resins and the reinforcing material that is of the mixed material are selected from various materials, and the blend ratio is properly set, so that the characteristic and the sound quality can accurately be adjusted than ever before. Additionally, on design such as the color, a wide variety of design can be implemented by the combination of the materials. The combination of the materials can infinitely be set, and the desired demand can be satisfied on the characteristic making, sound making, and design.

Figure 3:
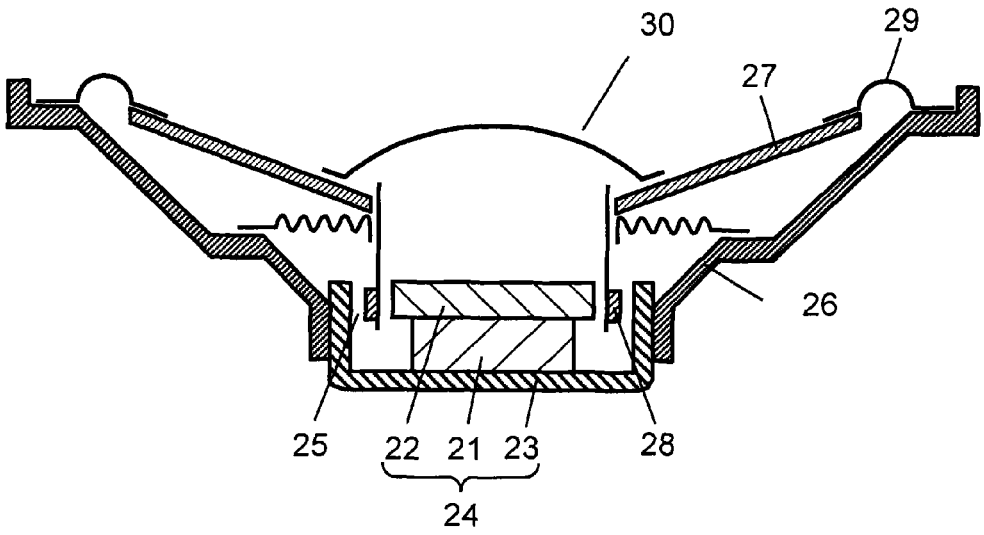
FIG. 3 is a sectional view illustrating a speaker of the first exemplary embodiment of the present invention.

Speaker 30 in which diaphragm 27 is used will be described below with reference to FIG. 3. FIG. 3 is a sectional view illustrating speaker 30 of the first exemplary embodiment of the present invention.

Speaker 30 includes magnetic circuit 24, frame 26, diaphragm 27, and voice coil 28.

Internal magnetic type magnetic circuit 24 is constructed by sandwiching magnetized magnet 21 between upper plate 22 and yoke 23. Frame 26 is coupled to yoke 23 of magnetic circuit 24. An outer circumference of diaphragm 27 is bonded to a peripheral edge portion of frame 26 with edge 29 interposed therebetween. That is, frame 26 supports the outer circumference of diaphragm 27. One end of voice coil 28 is coupled to a center portion of diaphragm 27, and the other end of voice coil 28 is fitted in magnetic gap 25 of magnetic circuit 24. Thus, voice coil 28 is partially disposed in an action range of a magnetic flux generated from magnetic circuit 24.

In the first exemplary embodiment, speaker 30 includes internal magnetic type magnetic circuit 24. Alternatively, diaphragm 27 may be applied to a speaker including an external magnet type magnetic circuit. The application of diaphragm 27 can expand the playback frequency bandwidth of speaker 30 and reduce the strain of speaker 30. Therefore, the sound quality of speaker 30 can be improved.

Figure 4:
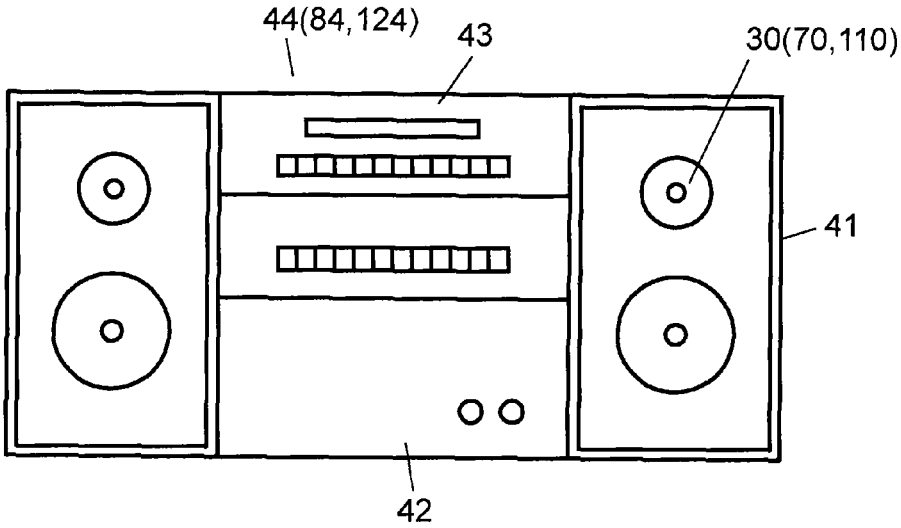
FIG. 4 is a view illustrating an appearance of an electronic device in first to third exemplary embodiments.

An electronic device in which speaker 30 is used will be described below with reference to FIG. 4. FIG. 4 is a view illustrating an appearance of an audio mini-component stereo system that is of the electronic device of the first exemplary embodiment.

Speaker 30 is incorporated in enclosure 41 to construct a speaker system. Amplifier 42 includes an amplifier circuit that amplifies an electric signal input to the speaker system. Operation unit 43 such as a player outputs a source input to amplifier 42. Thus, mini-component stereo system 44 includes amplifier 42, operation unit 43, and speaker system. Amplifier 42, operation unit 43, and enclosure 41 constitute a main body of mini-component stereo system 44. An electric power is fed from amplifier 42 of the main body to voice coil 28 of speaker 10, and voice coil 28 generates a sound from diaphragm 27.

The above configuration enables the highly accurate characteristic making, sound making, and design, which cannot be implemented conventionally. As a result, mini-component stereo system 44 can play back music with good sound quality.

In the first exemplary embodiment, speaker 30 is applied to audio mini-component stereo system 44. However, speaker 30 is not limited to audio mini-component stereo system 44. For example, speaker 30 can also be applied to a portable audio device. Speaker 30 can widely applied to video devices such as a liquid crystal television set and plasma display television set, information communication devices such as a mobile phone, and electronic devices such as a computer-related device.

An apparatus in which speaker 30 is used will be described below with reference to FIG. 5.

Figure 5:
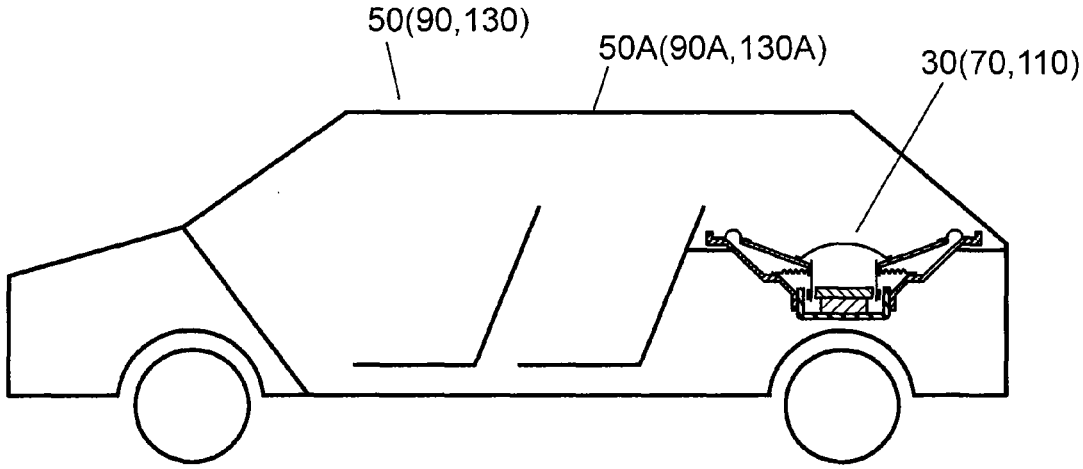
FIG. 5 is a sectional view illustrating an apparatus in the first to third exemplary embodiments.

FIG. 5 is a sectional view illustrating automobile 50 that is of the apparatus of the first exemplary embodiment.

Automobile 50 is configured such that speaker 30 is used as a part of a car navigation system or a car audio system while incorporated in a rear tray or a front panel.

In other words, automobile 50 includes speaker 30 and moving unit 50A on which speaker 30 is mounted.

The above configuration enables the highly accurate characteristic making, sound making, and design, which cannot be implemented conventionally. As a result, the sound quality can be improved in the apparatus such as automobile 50 on which speaker 30 is mounted.

Second Exemplary Embodiment

Figure 6:
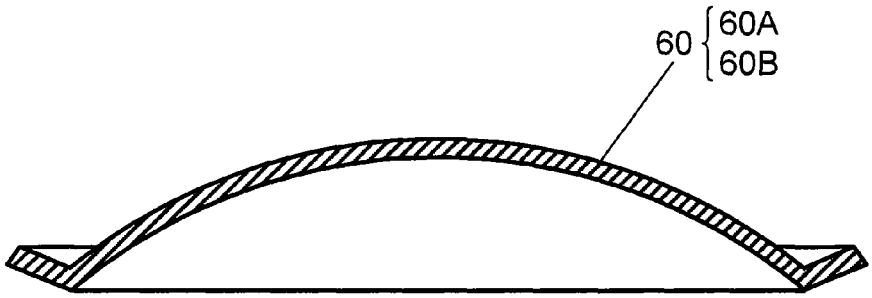
FIG. 6 is a sectional view illustrating a speaker dust cap according to the second exemplary embodiment of the present invention.

The case that the present invention is applied to a speaker dust cap from the viewpoint of enhancing the stiffness of the material for the speaker will be described below with reference to FIG. 6. The detailed description about the portion that is already described in the first exemplary embodiment is omitted, and a different point is mainly described. FIG. 6 is a sectional view illustrating a speaker dust cap of the second exemplary embodiment of the present invention. Dust cap 60 includes resin 60A and plant opal 60B that is extracted from the bamboo leaf. Dust cap 60 is formed by the injection molding or sheet molding of the material in which resin 60A and plant opal 60B are mixed. Dust cap 60 may include a material except resin 60A and plant opal 60B extracted from the bamboo leaf.

Desirably the mix rate of the plant opal extracted from the bamboo leaf ranges from 5 wt % to 30 wt % inclusive. When the mix rate of the plant opal contained in the bamboo leaf is lower than 5 wt %, there is a little effect that improves the sound velocity. On the other hand, when the mix rate of the plant opal extracted from the bamboo leaf exceeds 30 wt %, it is difficult to perform the sheet molding and the injection molding, and the productivity and the dimensional stability are degraded to decrease the degree of freedom of the shape setting.

As described above, in the present invention, the speaker dust cap is formed by the injection molding or the sheet molding of the material in which the resin and the plant opal extracted from the bamboo leaf are mixed. Therefore, the stiffness, toughness, sound velocity, and Young's modulus of the dust cap are enhanced to achieve high sound quality such as high clarity playback of the speaker, and the large output and high reliability can be achieved. The speaker dust cap having a small environmental load can inexpensively be provided with high productivity.

Figure 7:
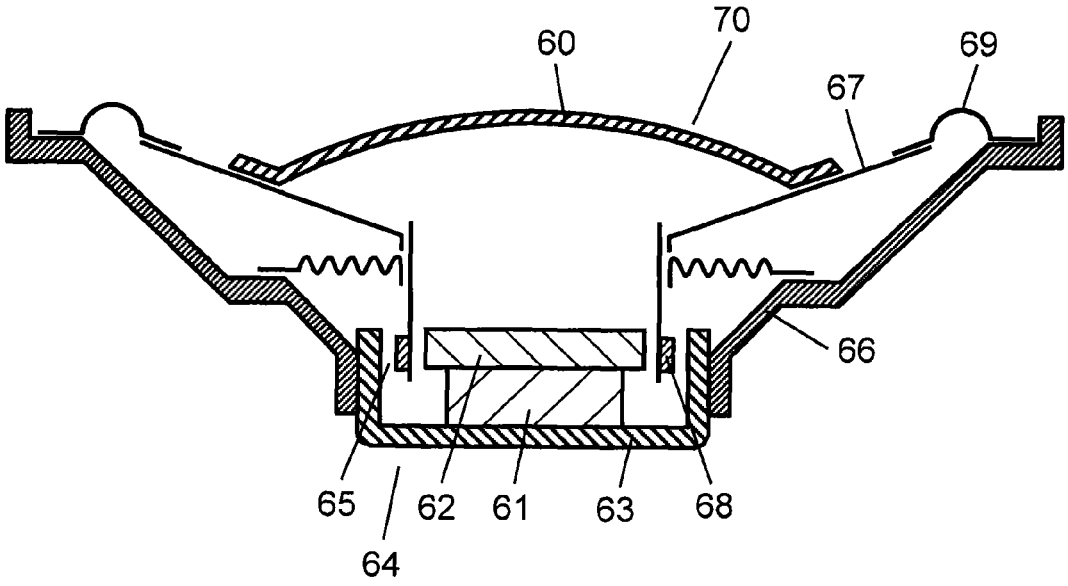
FIG. 7 is a sectional view illustrating a speaker of the second exemplary embodiment of the present invention.

A speaker in which dust cap 60 is used will be described with reference to FIG. 7. FIG. 7 is a sectional view illustrating a speaker of the second exemplary embodiment of the present invention. Speaker 70 includes magnetic circuit 64, frame 66, diaphragm 67, voice coil 68, and dust cap 60.

Internal magnetic type magnetic circuit 64 is constructed by sandwiching magnetized magnet 61 between upper plate 62 and yoke 63. Frame 66 is coupled to yoke 63 of magnetic circuit 64. An outer circumference of diaphragm 67 is bonded to a peripheral edge portion of frame 66 with edge 69 interposed therebetween. That is, frame 66 supports the outer circumference of diaphragm 67. One end of voice coil 68 is coupled to a center portion of diaphragm 67, and the other end of voice coil 68 is fitted in magnetic gap 65 of magnetic circuit 64. That is, voice coil 68 is partially disposed in the action range of the magnetic flux generated from magnetic circuit 64. Dust cap 60 is coupled to a front surface of diaphragm 67.

In the second exemplary embodiment, speaker 70 includes internal magnetic type magnetic circuit 64. Alternatively, dust cap 60 may be applied to a speaker including an external magnet type magnetic circuit.

As described above, the application of dust cap 60 can improve a sound pressure level in a high range of the speaker, the clear, powerful sound quality is achieved in the high range, and the large output and high reliability can be achieved. Additionally, the speaker, in which various kinds of reliability typified by the high-input resistance and the moisture resistance are improved and the beautiful, hardly-discolored, stable appearance is retained for a long time, can be constructed. The effect of the dust cap tends to be largely exerted with increasing external dimension of the dust cap.

An electronic device in which speaker 70 is used will be described with reference to FIG. 4. FIG. 4 is a view illustrating an appearance of audio mini-component stereo system 84 that is of the electronic device of the second exemplary embodiment.

In the configuration in FIG. 4, the improvement of the sound pressure level in the high range, which is not implemented conventionally, can be achieved, and therefore the mini-component stereo system in which the clear, powerful sound quality is obtained can be implemented. Additionally, the speaker system, in which various kinds of reliability typified by the high-input resistance and the moisture resistance are improved and the beautiful, hardly-discolored, stable appearance is retained for a long time, can be constructed.

An apparatus in which speaker 70 is used will be described below with reference to FIG. 5.

FIG. 5 is a sectional view illustrating automobile 90 that is of the apparatus of the second exemplary embodiment.

Automobile 90 is configured such that speaker 70 is used as a part of the car navigation system or the car audio system while incorporated in the rear tray or the front panel.

In other words, automobile 90 includes speaker 70 and moving unit 90A on which speaker 70 is mounted.

In the configuration in FIG. 5, the improvement of the sound pressure level in the high range, which is not implemented conventionally, can be achieved by utilizing the feature of speaker 70, and therefore the apparatus such as the automobile in which the clear, powerful sound quality is obtained can be implemented.

Additionally, various kinds of reliability typified by the high-input resistance and the moisture resistance are improved as the speaker, and the apparatus such as the automobile in which the beautiful, hardly-discolored, stable appearance is retained for a long time can be constructed.

Third Exemplary Embodiment

Figure 8:
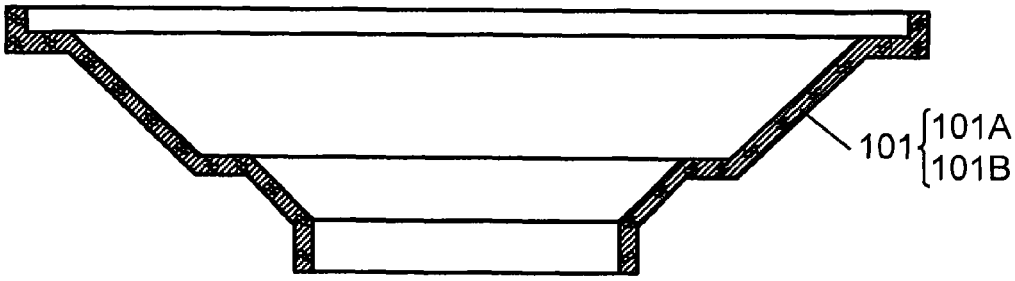
FIG. 8 is a sectional view illustrating a speaker frame according to the third exemplary embodiment of the present invention.

The case that the present invention is applied to a speaker frame (hereinafter referred to as a frame) from the viewpoint of enhancing the stiffness of the material for the speaker will be described below with reference to FIG. 8. The detailed description about the portion that is already described in the first and second exemplary embodiments is omitted, and a different point is mainly described. FIG. 8 is a sectional view illustrating the frame of the third exemplary embodiment of the present invention. Frame 101 includes resin 101A and plant opal 101B extracted from the bamboo leaf. Frame 101 is formed by the injection molding of the material including resin 101A and plant opal 101B. Frame 101 may include a material except the above materials.

The plant opal extracted from the bamboo leaf has a function of enhancing the elastic modulus. Therefore, when the plant opal extracted from the bamboo leaf is used as the material for frame 101, the stiffness of frame 101 can be improved.

Desirably the mix rate of the plant opal extracted from the bamboo leaf ranges from 5 wt % to 40 wt % inclusive. When the mix rate of the plant opal contained in the bamboo leaf is lower than 5 wt %, there is a little effect that improves the stiffness. On the other hand, when the mix rate of the bamboo fiber is more than 40 wt %, a merit of weight reduction is hardly exerted compared with the conventional one.

Desirably the particle diameter of plant opal 101B used ranges from 5 μm to 20 μm.

Desirably the plant-based fiber is further included as the material for frame 101.

Desirably the plant-based fiber is the bamboo fiber. Compared with a conventional glass fiber, the weight reduction of the frame and the improvement of the internal loss can be achieved by mixing the bamboo fiber. The bamboo fiber also has a function of improving the elastic modulus without increasing largely the specific weight of the material, and a function of improving the internal loss. Therefore, the resonance of the frame is reduced, the sound pressure frequency characteristic of the speaker can be planarized, and the strain can be reduced.

Desirably, in frame 101, the mix rate of the bamboo fiber ranges from 5 wt % to 60 wt % inclusive. When the mix rate of the bamboo fiber is lower than 5 wt %, there is a little effect that the bamboo fiber improves the stiffness. For the little mix rate of the bamboo fiber, when the bamboo fiber that is fined into the microfibril state is used, the effect of the mixed bamboo fiber is effectively exerted. It is necessary that frame 101 include a quantity of resin in order to form frame 101 by the injection molding. Therefore, in consideration of the mix of the plant opal extracted from the bamboo leaf, desirably the mix rate of the bamboo fiber is equal to or lower than 60 wt %. When the mix rate of the bamboo fiber exceeds 51 wt %, the frame can be incinerated and disposed as not the resin but the bamboo fiber.

Not the bamboo fiber (normal bamboo fiber), but the bamboo fiber that is fined into the microfibril state may be used as a part of the material for frame 101.

Desirably, in the bamboo fiber fined into the microfibril state, the beating degree is equal to or lower than 25 cc.

As used herein, the bamboo fiber that fined into the microfibril state means one in which the bamboo fiber is beaten into the microfibril state. In the beating process, the average fiber diameter is decreased while the average fiber length is substantially kept constant. The entanglement between fibers, particularly the entanglement with another material can be strengthened, and therefore the stiffness and toughness of frame 101 can be enhanced.

In the case of the addition of the bamboo fiber that is fined into the microfibril state having the beating degree of 25 cc or less, desirably the total mix rate of the normal bamboo fiber and the bamboo fiber that is fined into the microfibril state having the beating degree of 25 cc or less ranges from 5 wt % to 60 wt % inclusive.

The bamboo fiber that is fined into the microfibril state has an elastic modulus higher than that of the normal bamboo fiber. The bamboo fiber that is fined into the microfibril state exists to strengthen the bonding between the fibers. The effects synergistically enhance the elastic modulus compared with the case that only the normal bamboo fiber is mixed, and impact strength is enhanced.

The bamboo powder may be added as the plant-based fiber in addition to the bamboo fiber, or the bamboo powder may be added instead of the bamboo fiber. The addition of the bamboo powder can implement the more natural, bright tone color. Even in the same content of the bamboo, the use of the bamboo powder enhances the fluidity to improve the moldability compared with the case that only the normal bamboo fiber is mixed.

The bamboo charcoal may be added as the plant-based fiber in addition to the bamboo fiber, or the bamboo charcoal may be added instead of the bamboo fiber. The bamboo fiber is charred, and the bamboo fiber is used in a bamboo charcoal state, so that the elastic modulus and the internal loss can be enhanced to improve performance of frame 101.

The bamboo charcoal that is of the charred bamboo material acts as the black coloring agent, which allows the high-quality appearance to be implemented.

When the bamboo charcoal that is of the charred bamboo material is mixed in the resin, desirably the particle diameter of the bamboo charcoal is equal to or lower than 150 μm. When the particle diameter of the bamboo charcoal is more than 150 μm, the bamboo charcoal is hardly dispersed in the resin, which causes the appearance defect and the quality variation. The lower limit of the particle diameter does not particularly exist. In consideration of a fiber characteristic, desirably the particle diameter of the bamboo charcoal is equal to or more than 1 μm.

When the particle diameter of the bamboo charcoal is brought close to the particle diameter of plant opal 101B extracted from the bamboo leaf, dispersibility is improved, and the diaphragm functions more effectively.

The process of charring the bamboo material means the process of burning the bamboo material at a temperature of 600° C. or more irrespective of a form of the bamboo material.

Frame 101 may further include the reinforcing material. Desirably mica, aluminum hydroxide, and talc are used as the reinforcing material. When mica is mixed as the reinforcing material, the elastic modulus can be enhanced. When talc is mixed as the reinforcing material, the internal loss can be increased. When aluminum hydroxide is mixed as the reinforcing material, fire retardancy can be provided. Similarly, when magnesium hydroxide or ammonium phosphate is mixed as the reinforcing material, the fire retardancy can be provided.

As described above, in the present invention, the speaker frame is formed by the injection molding of the material in which the resin and the plant opal extracted from the bamboo leaf are mixed, so that the weight reduction can be achieved while the stiffness of the frame is enhanced. Therefore, the weight reduction, the high sound quality, the improvement of the impact strength, and the high reliability of the speaker can be achieved. Additionally, because the use of the bamboo improves the internal loss, the resonance of the frame is reduced, the sound pressure frequency characteristic of the speaker can be planarized, and the strain can be reduced.

Figure 9:
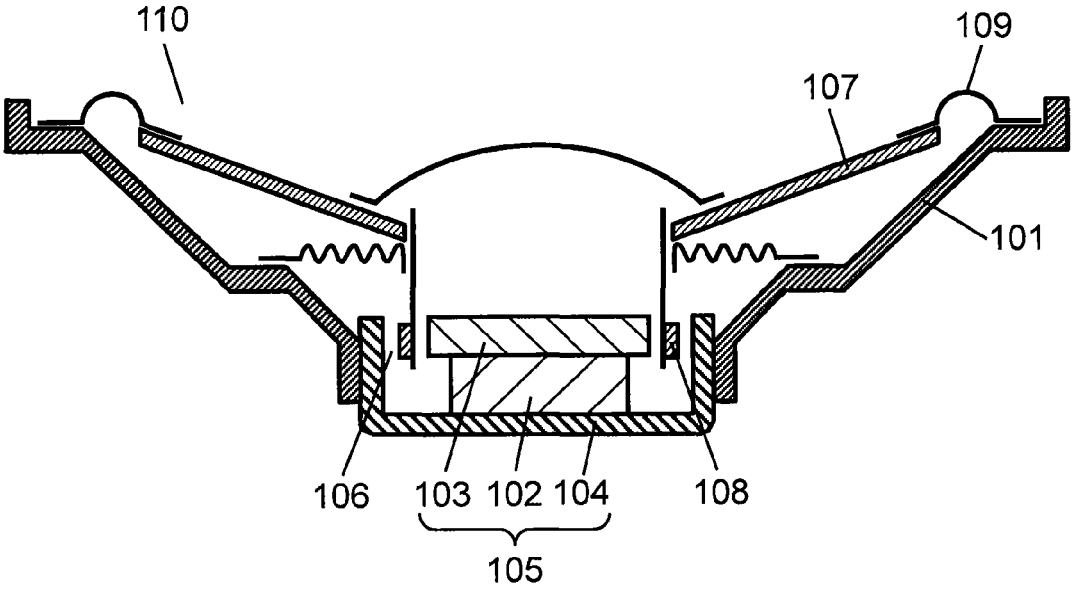
FIG. 9 is a sectional view illustrating a speaker of the third exemplary embodiment of the present invention.
Figure 10:
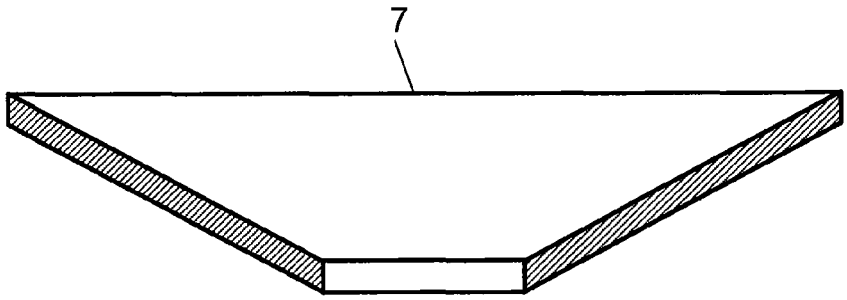
PRIOR ART FIG. 10
FIG. 10 is a sectional view illustrating a conventional speaker diaphragm.

The environmental load can also be reduced. Speaker 110 in which frame 101 is used will be described below with reference to FIG. 9. FIG. 9 is a sectional view illustrating the speaker of the third exemplary embodiment of the present invention. Speaker 110 includes magnetic circuit 105, frame 101, diaphragm 107, and voice coil 108.

Internal magnetic type magnetic circuit 105 is constructed by sandwiching magnetized magnet 102 between upper plate 103 and yoke 104. Frame 101 is coupled to yoke 104 of magnetic circuit 105. An outer circumference of diaphragm 107 is bonded to a peripheral edge portion of frame 101 with edge 109 interposed therebetween. One end of voice coil 108 is coupled to a center portion of diaphragm 107, and the other end of voice coil 108 is fitted in magnetic gap 106 of magnetic circuit 105. That is, voice coil 108 is partially disposed in the action range of the magnetic flux generated from magnetic circuit 105.

In the third exemplary embodiment, speaker 110 includes internal magnetic type magnetic circuit 105. Alternatively, frame 101 may be applied to a speaker including an external magnet type magnetic circuit.

As described above, the application of frame 101 can achieve the weight reduction, the high sound quality, the improvement of the impact strength, and the high reliability of speaker 110. Additionally, because the use of the bamboo improves the internal loss, the resonance of the frame is reduced, the sound pressure frequency characteristic of the speaker can be planarized, and the strain can be reduced.

The environmental load can also be reduced.

An electronic device in which speaker 110 is used will be described below with reference to FIG. 4. FIG. 4 is a view illustrating an appearance of audio mini-component stereo system 124 that is of the electronic device of the third exemplary embodiment.

Mini-component stereo system 124 that can achieve the weight reduction, the high sound quality, the high reliability, and the reduction of the environmental load, which are not implemented conventionally, is obtained by the configuration in FIG. 4.

In the third exemplary embodiment, speaker 110 is applied to audio mini-component stereo system 124. However, speaker 110 is not limited to audio mini-component stereo system 124. For example, speaker 110 can also be applied to a portable audio device. Speaker 110 can widely applied to video devices such as a liquid crystal television set and plasma display television set, information communication devices such as a mobile phone, and electronic devices such as a computer-related device.

An apparatus in which speaker 110 is used will be described below with reference to FIG. 5. FIG. 5 is a sectional view illustrating automobile 130 that is of the apparatus of the third exemplary embodiment. Automobile 130 includes speaker 110 and moving unit 130A on which speaker 110 is mounted.

The apparatus such as the automobile, in which the features of speaker 110 are utilized to achieve the weight reduction, the high sound quality, the high reliability, and the reduction of the environmental load, can be implemented by the configuration in FIG. 4.

In the first to third exemplary embodiments, the speaker diaphragm, the speaker dust cap, and the speaker frame are described. Alternatively, the combination of the speaker diaphragm, the speaker dust cap, and the speaker frame may be applied to the speaker, the electronic device, and the apparatus.

INDUSTRIAL APPLICABILITY

The speaker frame, the speaker dust cap, the speaker frame, the speaker using the same, the electronic device, and the apparatus of the present invention can be applied to the electronic devices such as the audio and visual device and the information communication device and the apparatus such as the automobile, in which the weight reduction, the high sound quality, the high reliability, and the reduction of the environmental load are required.

REFERENCE MARKS IN THE DRAWINGS

7, 27, 67, 107 diaphragm
24, 64, 105 magnetic circuit
25, 65, 106 magnetic gap
26, 66, 101 frame
27A, 60A, 101A resin
27B, 60B, 101B plant opal extracted from bamboo leaf
28, 68, 108 voice coil
30, 70, 110 speaker
41 enclosure
42 amplifier
43 operation unit
44, 84, 124 mini-component stereo system
50, 90, 130 automobile
50A, 90A, 130A moving unit
60 dust cap

The invention claimed is:

1. A speaker diaphragm formed by injection molding or sheet molding, comprising:
a resin; and
a plant opal extracted from a bamboo leaf.

2. The speaker diaphragm according to claim 1, wherein a mix rate of the plant opal ranges from 5 wt % to 50 wt % inclusive.

3. The speaker diaphragm according to claim 1, further comprising a plant-based fiber.

4. The speaker diaphragm according to claim 3, wherein the plant-based fiber is a bamboo fiber.

5. The speaker diaphragm according to claim 4, wherein a content of the bamboo fiber ranges from 5 wt % to 60 wt % inclusive.

6. The speaker diaphragm according to claim 4, wherein the bamboo fiber includes a bamboo fiber that is fined into a microfibril state having a beating degree of 25 cc or less.

7. The speaker diaphragm according to claim 4, further comprising a bamboo powder.

8. The speaker diaphragm according to claim 4, further comprising a bamboo charcoal made by charring the bamboo fiber.

9. The speaker diaphragm according to claim 3, wherein the plant-based fiber is a bamboo powder.

10. The speaker diaphragm according to claim 3, wherein the plant-based fiber is a bamboo charcoal made by charring the bamboo fiber.

11. The speaker diaphragm according to claim 1, further comprising a reinforcing material.

12. The speaker diaphragm according to claim 2, further comprising a compatibilizing agent.

13. The speaker diaphragm according to claim 1, wherein the resin is polypropylene.

14. The speaker diaphragm according to claim 1, wherein the resin is a plant-based resin.

15. A speaker comprising:
a magnetic circuit;
a frame coupled to the magnetic circuit;
the diaphragm according to claim 1 that is coupled to an outer peripheral portion of the frame; and
a voice coil that is coupled to the diaphragm, wherein
the voice coil is partially disposed in an action range of a magnetic flux generated from the magnetic circuit.

16. An electronic device comprising:
the speaker according to claim 15; and
a main body that feeds an electric power to the speaker.

17. An apparatus comprising:
the speaker according to claim 15; and
a moving unit on which the speaker is mounted.

18. The speaker diaphragm according to claim 1, wherein a particle diameter of the plant opal ranges from 5 μm to 20 μm.

19. The speaker diaphragm according to claim 15 further comprising a dust cap, wherein a mix rate of the plant opal in the speaker diaphragm ranges from 5 wt % to 50 wt % inclusive, and a mix rate of the plant opal in the dust cap ranges from 5 wt % to 30 wt inclusive.

20. The speaker diaphragm according to claim 19, wherein a mix rate of the plant opal in the frame ranges from 5 wt % to 40 wt % inclusive.

* * * * *